US005680464A

United States Patent [19]

Iwamatsu

[11] Patent Number: 5,680,464

[45] Date of Patent: Oct. 21, 1997

[54] SOUND FIELD CONTROLLING DEVICE

[75] Inventor: Masayuki Iwamatsu, Hamamatsu, Japan

[73] Assignee: Yamaha Corporation, Japan

[21] Appl. No.: 620,706

[22] Filed: Mar. 21, 1996

[30] Foreign Application Priority Data

Mar. 30, 1995 [JP] Japan ..... 7-098144

[51] Int. Cl.[6] ..... H04R 5/00

[52] U.S. Cl. ..... 381/18; 381/63

[58] Field of Search ..... 381/1, 17, 18, 381/63

[56] References Cited

U.S. PATENT DOCUMENTS 5,261,005 11/1993 Masayuki ..... 381/18

5,524,053 6/1996 Iwamatsu ..... 381/63

*Primary Examiner*—Minsun Oh

*Attorney, Agent, or Firm*—Graham & James LLP

[57] ABSTRACT

An AC-3 decoder output signals of five channels, i.e., main signals of left front, center front and right front channels and surround signals of two channels. A first synthesizing section synthesizes the three-channel main signals and a difference signal between the two-channel surround signals, and the resultant synthesized signals are then fed to a main sound field signal forming section which in turn forms main sound field signals. A second synthesizing section synthesizes the surround signals of the two channels and a difference signal between the main signals of the left and right channels, and the resultant synthesized signals are fed to a surround sound field signal forming section which in turn forms surround sound field signals. A composite sound field forming section synthesizes the main sound field signals, surround sound field signals and original surround signals so as to form composite sound field signals. The main signals of the three channels are reproduced via a set of left-, center- and right-front speakers, and composite sound field signals are reproduced via another set of left- and right-front speakers and left- and right-rear speakers.

7 Claims, 5 Drawing Sheets

SOUND FIELD CONTROLLING DEVICE

BACKGROUND OF THE INVENTION

The present invention relates generally to sound field controlling devices for reproducing the atmosphere or presence of a movie or the like at home or in other places than movie theaters, and more particularly to a sound field controlling device which can perform optimum sound field creating operations on sound signals of three front channels and two surround channels.

In recent years, more and more audio/video (AV) apparatuses have been equipped with a sound field controlling device in order to faithfully approximate the dynamic presence of a movie or the like at home or in other places than movie theaters. Various sound field controlling devices have hitherto been developed, among which are: so-called surround processors that are designed to first extract sound field components (e.g., reverberation components) contained in source signals and then output the thus-extracted components as surround signals typically after having emphasized their strength; and surround systems, e.g., a Dolby surround (trademark) system and Dolby prologic surround (trademark) system which, at the time of reproduction, decode pre-encoded two-channel source signals into four channels by means of a surround decoder.

In movie theaters showing 70 mm movies, sounds are reproduced from a 6-channel multitrack magnetic tape synchronized with an associated film. Because the tape is multitrack with the individual tracks being independent of one another, rich expansion of sound can be created while achieving clear localization.

A great number of software movies recorded on laser vision disks (LV) and video tapes are commercially available today for viewing at home. Typically, when producing a surround movie in a disk or tape, Dolby surround encoding processing has to be applied to record 6-channel multitrack sounds in two tracks. Then, at the time of reproduction, the sounds are restored by a Dolby prologic decoder to four channels, left (L), center (C), right (R) and surround (S) channels.

Sound engineers or producers for movies have designed surround sounds which provide an effect to encircle the audience (namely, a feeling of encirclement). However, because of a practical limitation at home that only two surround speakers can usually be placed at the back of a listening position, monaural surround output from the surround decoder would be undesirably localized in the center rear. In order to avoid this inconvenience, an attempt has been made to process the monaural surround channel by use of a pseudo stereophonic process, but a feeling of expansion afforded by the two rear speakers alone was insufficient, and consequently, the listener could not obtain a feeling of encirclement continuous from the front movie screen as in a 70 mm movie theater.

U.S. Pat. No. 5,261,005 discloses a sound field controlling device which is designed to overcome the above-discussed problems and achieve a feeling of encirclement satisfactory to the listener just as in a 70 mm movie theater, when used with an encoding/decoding-based surround system which receives two-channel signals prepared by encoding a plurality of main signals to be localized is front of a listener and surround signals to be reproduced with a feeling of encirclement and then decodes the main signals and surround signals from the received two-channel signals. In the disclosed device, to prevent the surround signals from being localized at any particular position, the surround signals are not directly reproduced; instead, reflected sound signals are formed, on the basis of the surround signals, for such directions to create a relatively wide sound field encircling the listening position. The reflected sound signals are reproduced via associated speakers disposed around the listening position.

Dolby AC-3 (trademark) is popularly known as one of the new surround systems, and this system can be suitably used for transmitting several pieces of tone source information (i.e., five-channel signals: main signals of left front, right front and center front channels L, R and C; and two-channel surround signals SR and SL) which are completely independent of one another. Because of the independence of the surround signals SR and SL, this system achieves great improvements; namely, with Dolby AC-3 system, surround sounds can be designed to afford a feeling of encirclement, to be heard from a single selected direction, or to assume a stereophonic effect, as intended by the sound producer.

Where the sound field control as disclosed in the above-mentioned Japanese publication No. HEI 4-150200 is to be applied to tone source information produced by the Dolby AC-3 system, reflected sound signals may be formed separately for the two-channel surround signals SL and SR, but in such a case, the structure for forming the signals SL and SR would be complicated. However, if the surround signals SL and SR are combined into a single-channel signal to avoid possible structural complexity and then subjected to surround signal processing as disclosed in U.S. Pat. No. 5,261,005, the original intention of the sound producer having designed the two-channel surround signals would be lost.

SUMMARY OF THE INVENTION

It is therefore an object of the present invention to provide a sound field controlling device which achieves optimum sound field control of sound signals of three front channels and two surround channels.

In a sound field controlling device according to a first aspect of the present invention, an input section inputs, to the device, original main signals of three channels that are to be reproduced at left, right and center fronts of a listening position and original surround signals of two channels that are to be reproduced at left and right rear or left and right sides of the listening position. A main signal synthesizing section synthesizes the original main signals of all the channels or of left and right channels inputted via the input section, so as to form a synthesized main signal. On the basis of first reflected sound parameters for creating a relatively narrow first sound field in front of the listening position, a main sound field signal forming section forms main sound field signals comprised of reflected sound signals of different directions defining the first sound field, with regard to the synthesized main signal. A surround signal synthesizing section synthesizes the original surround signals of the two channels inputted via the input section, so as to form a synthesized surround signal. On the basis of second reflected sound parameters for creating a relatively wide second sound field encircling the listening position, a surround sound field signal forming section forms surround sound field signals comprised of reflected sound signals of different directions defining the second sound field, with regard to the synthesized surround signal. A composite sound field signal forming section synthesizes the main sound field signals and surround sound field signals of the corresponding channels, and also synthesizes the original surround signals of the two channels with channels to be reproduced at left and right rear or left and right sides of the listening position, so as to form composite sound field signals of the individual channels. An output section outputs the original main signals of the three channels along with the composite sound field signals.

In a sound field controlling device according to second aspect of the present invention, the above-mentioned input section is replaced with a decoder section for decoding input signals that are prepared by encoding, into a single-channel serial digital signal, original main signals of three channels to be reproduced at left, right and center fronts of the listening position and original surround signals of two channels to be reproduced at left and right rear or left and right sides of the listening position, and thereby outputting five-channel discrete signals comprised of the original main signals of the three channels and the original surround signals of the two channels. Similarly to the first aspect, the device includes a main signal synthesizing section for synthesizing the original main signals of all the channels or of left and right channels inputted via the input section so as to form a synthesized main signal, a main sound field signal forming section for, on the basis of first reflected sound parameters for creating a relatively narrow first sound field in front of the listening position, forming main sound field signals comprised of reflected sound signals of different directions defining the first sound field, with regard to the synthesized main signal, a surround signal synthesizing section for synthesizing the original surround signals of the two channels inputted via the input section so as to form a synthesized surround signal, a surround sound field signal forming section for, on the basis of second reflected sound parameters for creating a relatively wide second sound field encircling the listening position, forming surround sound field signals comprised of reflected sound signals of different directions defining the second sound field, with regard to the synthesized surround signal, a composite sound field signal forming section for synthesizing the main sound field signals and surround sound field signals of the corresponding channels and for also synthesizing the original surround signals of the two channels with channels to be reproduced at left and right rears or left and right sides of the listening position, so as to form composite sound field signals of the individual channels, and an output section for outputting the original main signals of the three channels along with the composite sound field signals.

With the sound field controlling device according to the first and second aspects, optimum sound field control is achieved using the original two-channel surround signals, because the two-channel original surround signals are synthesized to thereby form reflected sound signals (surround sound field signals) for creating a relatively wide sound field encircling the listening position and the original two-channel surround signals are reproduced after having been synthesized with those of the formed surround sound field signals which are to be reproduced at left-and right rear or left and right sides of the listener's position.

In both the above-mentioned devices according to the first and second aspects, when necessary, the main signal synthesizing section may synthesize a difference signal between the original surround signals of the two channels in addition to the original main signals of all the channels or of left and right channels, and the surround signal synthesizing section may synthesize a difference signal between the original main signals of the left and right channels in addition to the original surround signals of the two channels.

The present invention may further comprises a switch section for switching between a first mode where the composite sound field signals are outputted directly from the composite sound field signal forming section, and a second mode where the composite sound field signals of only the main sound field signals and surround sound field signals are outputted from the composite sound field signal forming section without the original surround signals of the two channels being outputted therefrom. Where the number of surround channel is set to one or two in accordance with a sound producer's selection as is typical with Dolby AC-3 system, it is determined whether the two-channel signals are identical or not, and if the two-channel signals are determined as identical (i.e, if the number of surround channel is one), the composite signals of only the main and surround sound field signals are outputted without the original surround signals being synthesized at all. Thus, this arrangement can follow the original intention (to not cause a surround signal to be localized at any particular position) of a sound producer who set a single-channel surround signal.

BRIEF DESCRIPTION OF THE DRAWINGS

For better understanding of the above and other features of the present invention, the preferred embodiments of the invention will be described hereinbelow with reference to the accompanying drawings, in which.

DETAILED DESCRIPTION OF THE PREFERRED EMBODIMENTS

Figure 1:
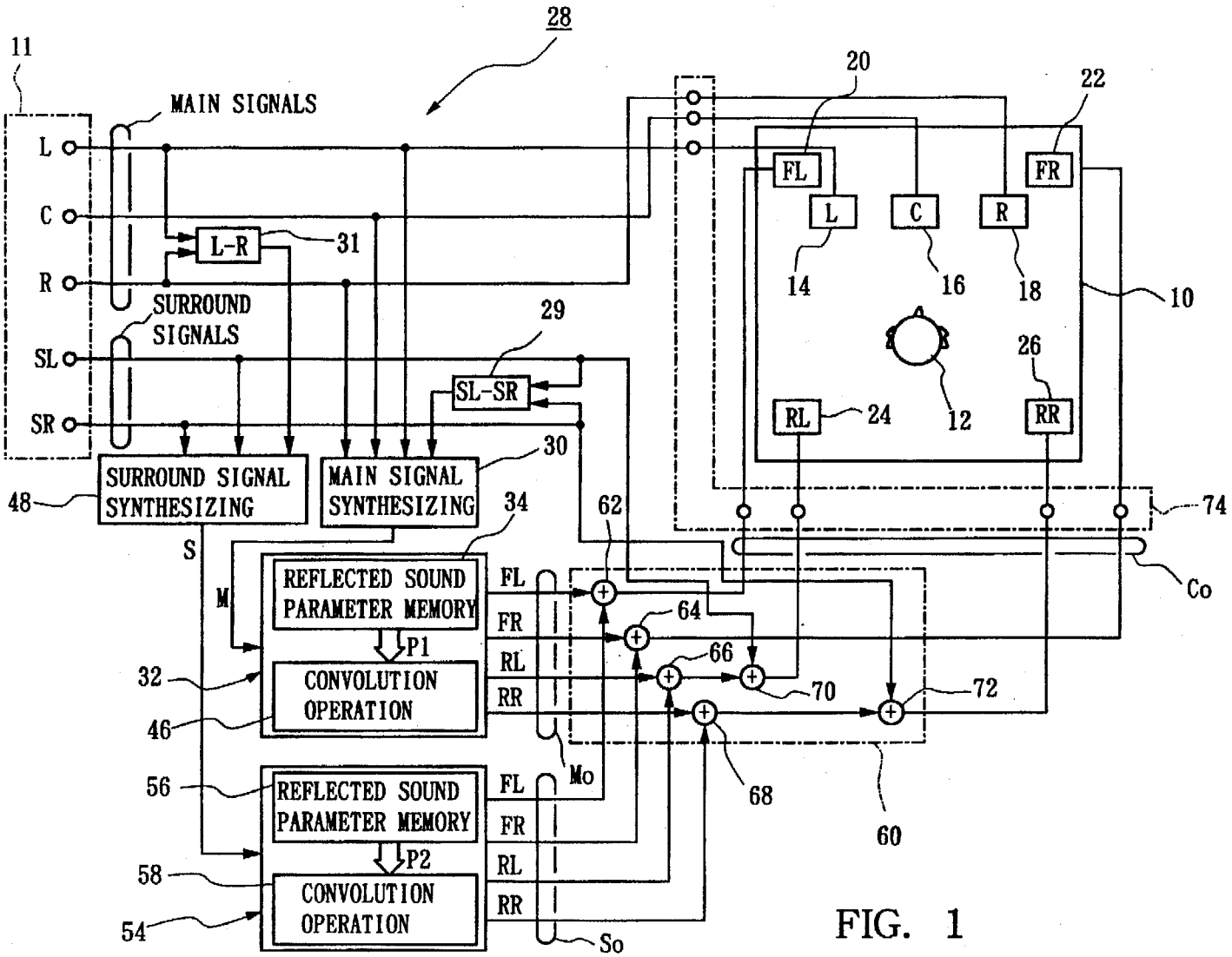
FIG. 1 is a block diagram illustrating an exemplary hardware structure of a sound field controlling device according to an embodiment of the present invention.

In the following description, reference characters "L", "R", "C", "FL", "FR", "RL" and "RR" used to refer to channels or directions indicate "left", "right", "center", "left front", "right front", "left rear" and "right rear", respectively.

FIG. 1 is a block diagram illustrating an overall hardware structure-of a sound field controlling device 28 according to an embodiment of the present invention.

In a listening room 10, speakers 14, 16 and 18 of three front channels L, C and R are disposed, as main speakers, to the left, center and right fronts of a listening position 12. Speakers 20, 22, 24 and 26 of channels FL, FR, RL and RR are also disposed, as sound field controlling speakers, to the left and right fronts and left and right rears of the listening position 12.

In this sound field controlling device 28, digital signals of three front channels L, C and R are introduced to an input section 11, as main signals to be reproduced at the left, center and right fronts respectively, of the listening position 12. Digital signals of two channels SL and SR are also introduced to the input section 11, as surround signals to be reproduced at the left and right rears or left and right sides of the listening position 12. According to the embodiment, these five-channel signals are signals prepared by the AC-3 or similar multichannel (in this example, five-channel) discrete transmission system.

Of these introduced or input signals, the main signals of channels L, C and R, and a difference signal between the surround signals SL and SR (SL–SR) calculated by a subtracter 29 are synthesized or added together by a main signal synthesizing section 30 using certain weights. In such synthesis, optional polarities and gains may be applied, as the weights, to the main signals L, C and R and difference signal (SL–SR). Namely, if the main signals L, C and R are added together with respective gains of +1, +1 and +1, the addition will be L+C+R; if the main signals are added together with respective gains of +1, +1 and −1, the addition will be L+C−R; if the main signals are added together with respective gains of +1, 0 and +1, the addition will be L+R; and if the main signals are added together with respective gains of +1, 0 and −1, the addition will be L−R. The respective gains of the main signals L, C and R and difference signal (SL–SR) may be set optionally to any values within a range of +1 to −1.

Exemplary gain setting of the main signals L, C and R will be described. In the case of reproduction of a movie, three kinds of sounds are generally localized in front of viewers or listeners: speech sounds of players (actors and actresses) localized to the center front; various special acoustic effect sounds; and background music sounds. These sounds localized in front of the listeners are included in three front channels L, C and R. For example, if it is desirable that music and effect sounds expand deep behind the screen with speech sounds of players clearly localized in a position not deep behind the screen, the gains of the signals L, C and R may be set respectively to "+1", "0" and "+1", or "+1", "0"and "−1", so that the main signal synthesizing section 30 outputs L+R or L−R. To realize the atmosphere of a 70 mm film theater, reflected sound parameters for creating main sound field signals may be suitably used which will create a relatively tight sound field where speech sounds are localized in the front screen (i.e., in front of the listening position) and effect and music sounds expand deep, behind the screen. In such a case, it is preferably that the gains of the signals L, C and R be set for example to "+1", "any value within +0.55 to +0.6" and "+1", respectively.

The difference signal (SL SR) between the surround channels is comprised mainly of indirect sound components, and the main sound field signals will realize an increased depth by incorporating a suitable amount of the difference signal (SL–SR). Although the incorporation of the difference signal between the surround signals is significant for this reason, incorporation of a difference signal between the main signals is of no significance since it is encompassed in the above-mentioned gain setting of the main signals. Also, the incorporation of the difference signal between the surround signals may be executed only when necessary.

Coefficients for the signals L, C, R and (SL–SR) are determined on the basis of a number of coefficient patterns stored in a ROM that is provided within a microcomputer. In the case where the ROM prestores various coefficient patterns for music videos of operas and live music concerts as well as movies in such a manner that any desired one of the patterns is read out to be set in the main signal synthesizing section 30, it is possible to achieve an optimum effect by controlling sound images in various ways, and thus markedly free acoustic effects can be designed.

On the basis of first reflected sound parameters P1 read out from a reflected sound parameter memory 34, main sound field signal forming section 32 creates a relatively narrow first sound field in front of the listening position, with regard to the combination of the main signals L, C and R and difference signal (SL–SR) (synthesized main signal M), by performing sound field control processing such as disclosed in U.S. Pat. No. 5,261,005. Namely, reflected sound parameter memory 34 prestores the first reflected sound parameters P1 that afford the first sound field suitable for the direction where the main signals L, C and R are to be localized. The reflected sound parameters P1 contain parameters for forming reflected sound signals to be generated by the individual sound field controlling speakers 20, 22, 24 and 26, in order to simulate the first sound field via the four speakers 20, 22, 24 and 26.

Figure 2:
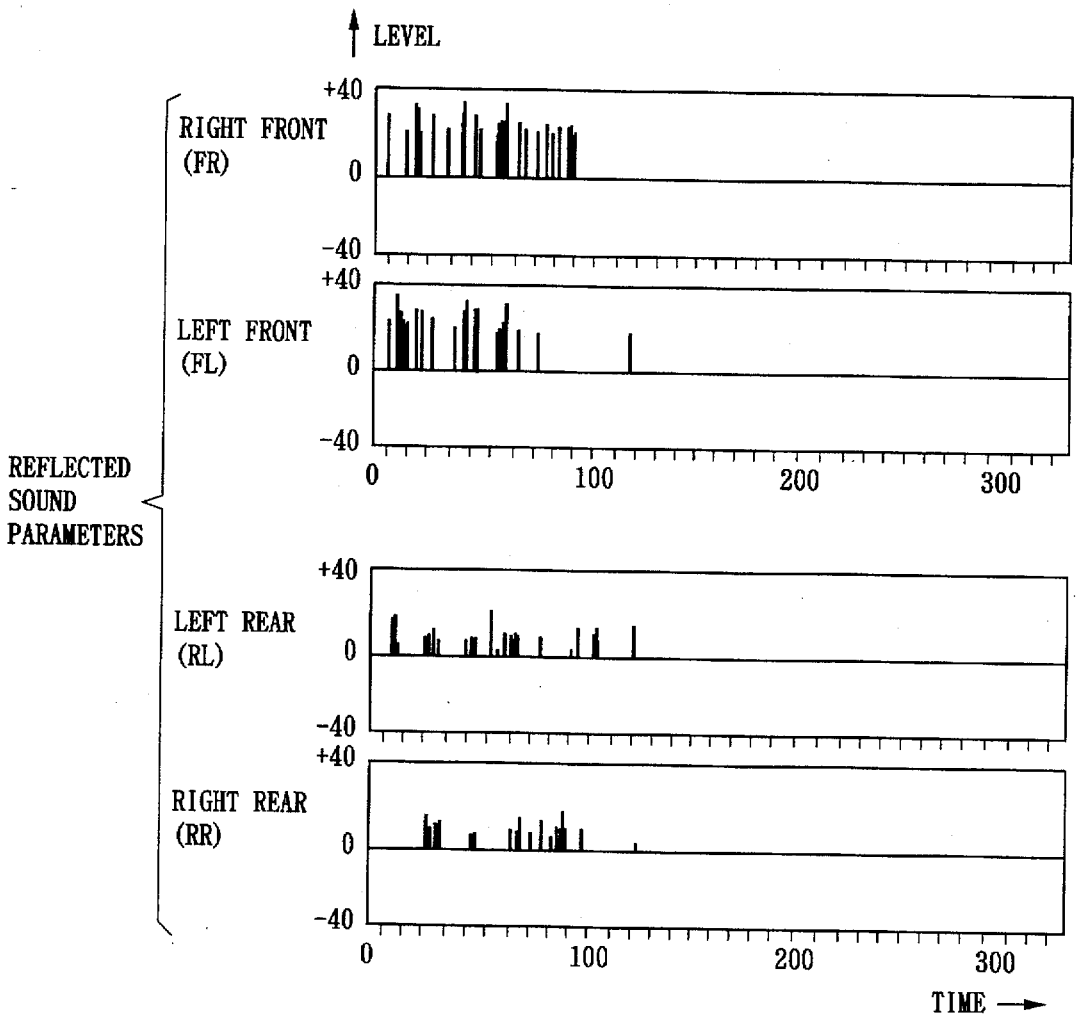
FIG. 2 is a diagram explanatory of exemplary reflected sound parameters for use in sound field control.

Specifically, the reflected sound parameters P1 comprise combinations of delay times and gains, which may be obtained from actual measurement in the first sound field, simulation-based virtual tone source distribution, or the like. Exemplary reflected sound parameters for creating a sound field are shown in FIG. 2. In the case of the reflected sound parameters P1 that afford the first sound field, in order to realize the atmosphere of a 70 mm movie theater, such parameters may be suitably used which create a relatively tight sound field where speech sounds are localized in the front screen and effect and music sounds expand deep behind the screen.

As the first reflected sound parameters P1, plural sets of reflected sound parameters for several possible sound fields may be prestored in the reflected sound parameter memory 34 so that the listener can select any desired one of the parameter sets or can partly change the values of the stored parameters.

Convolution operation section 46 digitally convolutes the reflected sound parameters P1 of individual directions with the synthesized main signal M, so as to form reflected sound signals FL, FR, FL and RR of the individual directions (i.e., left-front, right-front, left-rear and right-rear directions) as main sound field signals Mo.

Meantime, the two-channel surround signals SL and SR and difference signal between the main signals L and R (L–R) calculated by a subtracter 31 are synthesized by a surround signal synthesizing section 48 to form a synthesized surround signal S. The reason why the difference signal between the main signals is incorporated to form the synthesized surround signal S as necessary is essentially the same as in the case of the main signal M; that is, because the signal is comprised mainly of indirect sound components and such indirect sound components can not be obtained by synthesization of the surround channel signals alone. As a result, the synthesized main signal M and synthesized surround signal S will have symmetry, and thus even where a sound producer designs sounds with the front and rear channels, i.e., the main and surround channels intentionally reversed, this sound field controlling scheme will properly reproduce an atmosphere where the front and rear are allowed to be reversed substantially as intended.

On the basis of second reflected sound parameters P2 read out from a reflected sound parameter memory 56, surround sound field signal forming section 54 creates a relatively wide second sound field, with regard to the synthesized surround signal S, which encircles the listening position 12. The surround sound field signal forming section 54 is similar in construction to the above-mentioned main sound field signal forming section 32. To realize the atmosphere of a 70 mm movie, parameters may be suitably used, as the second reflected sound parameters P2, which form a wide surround sound field localized to encircle the listening position 12.

Convolution operation section 58 digitally convolutes the second reflected sound parameters P2 of individual directions with the synthesized surround signal S, so as to form reflected sound signals FL, FR, FL and RR of the individual directions (i.e., left-front, right-front, left-rear and right-rear directions) as surround sound field signals So.

Adders 62, 64, 66 and 68 are provided in corresponding relations to the above-mentioned channels FL, FR, FL and RR, and each of the adders 62, 64, 66, 68 adds together the main sound field signal Mo and surround sound field signal So of the corresponding channel. Of the thus added sound field signals, the signals of left-rear and right-rear channels RL and RR are further added via adders 70 and 72 with the original surround signals SL and SR, respectively. Thus, composite sound field signal forming section 60 provides composite sound field signals Co of the individual channels.

The main signals of three channels L, C and R and the composite sound field signals Co of channels FL, FR, RL and RR provided from the composite sound field signal forming section 60 are then output from an output section 74 of the device 28 by way of an unillustrated D/A converter, power amplifier, etc., and supplied to the speakers 14, 16, 18, 20, 22, 24 and 26 of the corresponding channels for audible reproduction.

Figure 3:
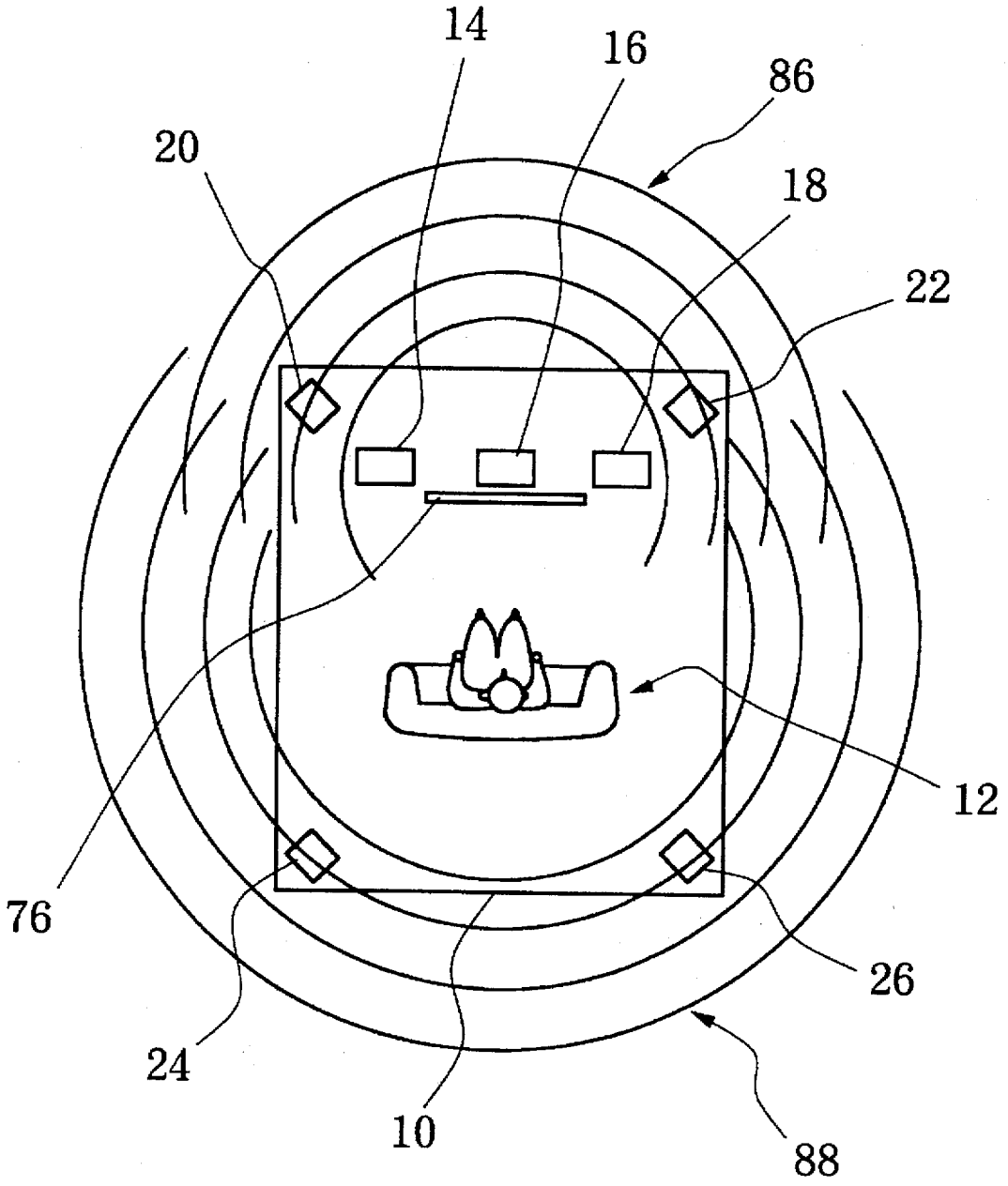
FIG. 3 is a plan view illustrating exemplary sound fields created in a room of FIG. 1.

In FIG. 3, there is shown exemplary sound fields created in the room 10 by use of the above-described sound field control. As shown, dialog sounds in source signals are localized by the central main speaker 16 in a central position of the screen 76. Front effect and music sounds are generated via the left-front and right-front main speakers 14 and 18 and also generated as main sound field signals Mo via the sound field controlling speakers 20, 22, 24 and 26 so as to form a main sound field 86. The main sound field 86 expands deep behind the screen 76 to add to the feeling of depth and presence of images on the screen 76.

Surround sounds are generated as surround sound field signals So via the sound field controlling speakers 20, 22, 24 and 26 so as to form a surround sound field 88 having a smooth, continuous link with the main sound field 86 and giving a feeling as if the listener is encircled by the sound field. Further, because the original surround signals SL and SR are also reproduced, with no change, via left-rear and right-rear channels RL and RR rather than being deadened, a surround feeling originally intended by the sound producer is also provided. In the above-mentioned manner, even a small number of speakers enable the listener to enjoy a movie or the like while fully appreciating a feeling of sufficient sound fields as in a 70 mm movie theater.

Other Embodiments

Figure 4A:
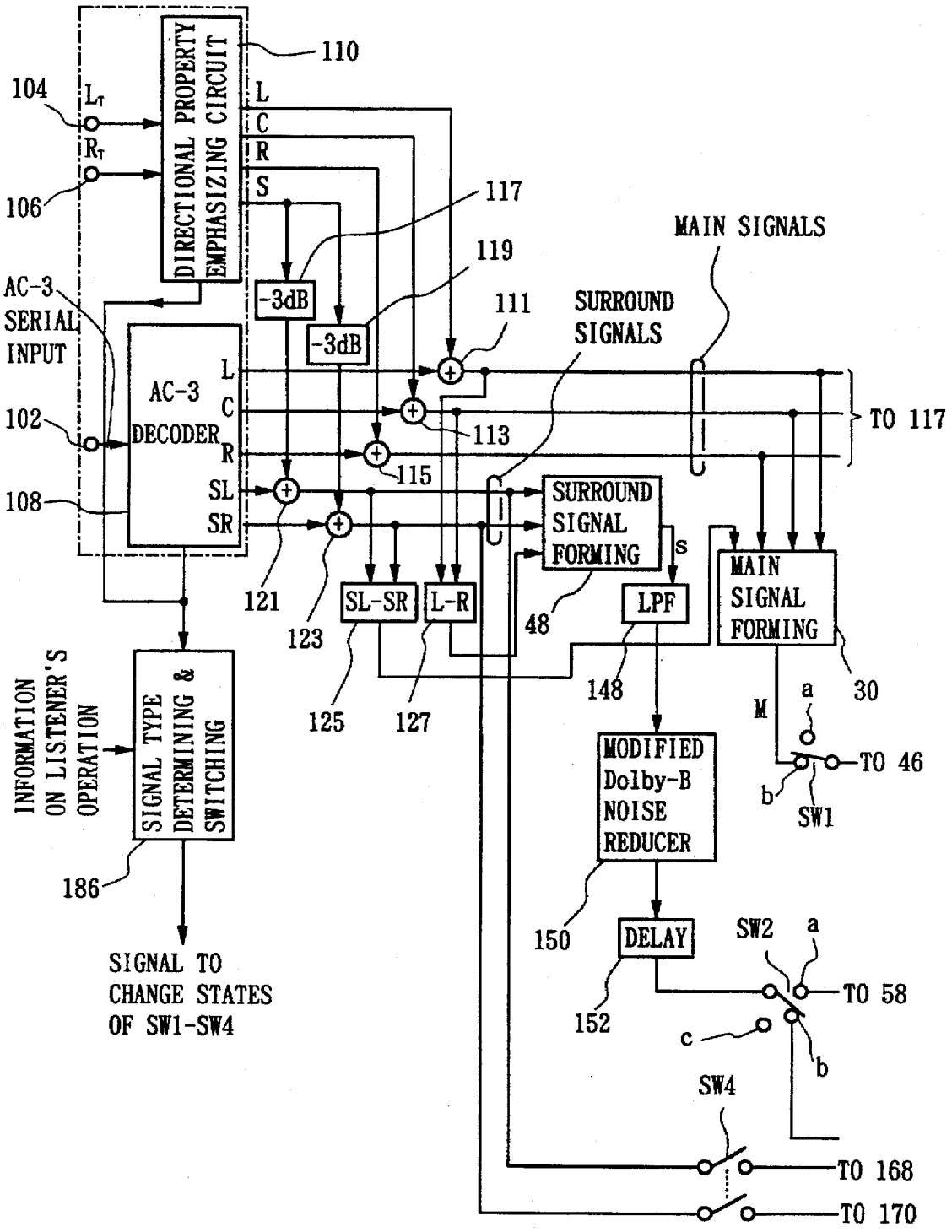
FIG. 4 is block diagrams illustrating another embodiment of the present invention.
Figure 4B:
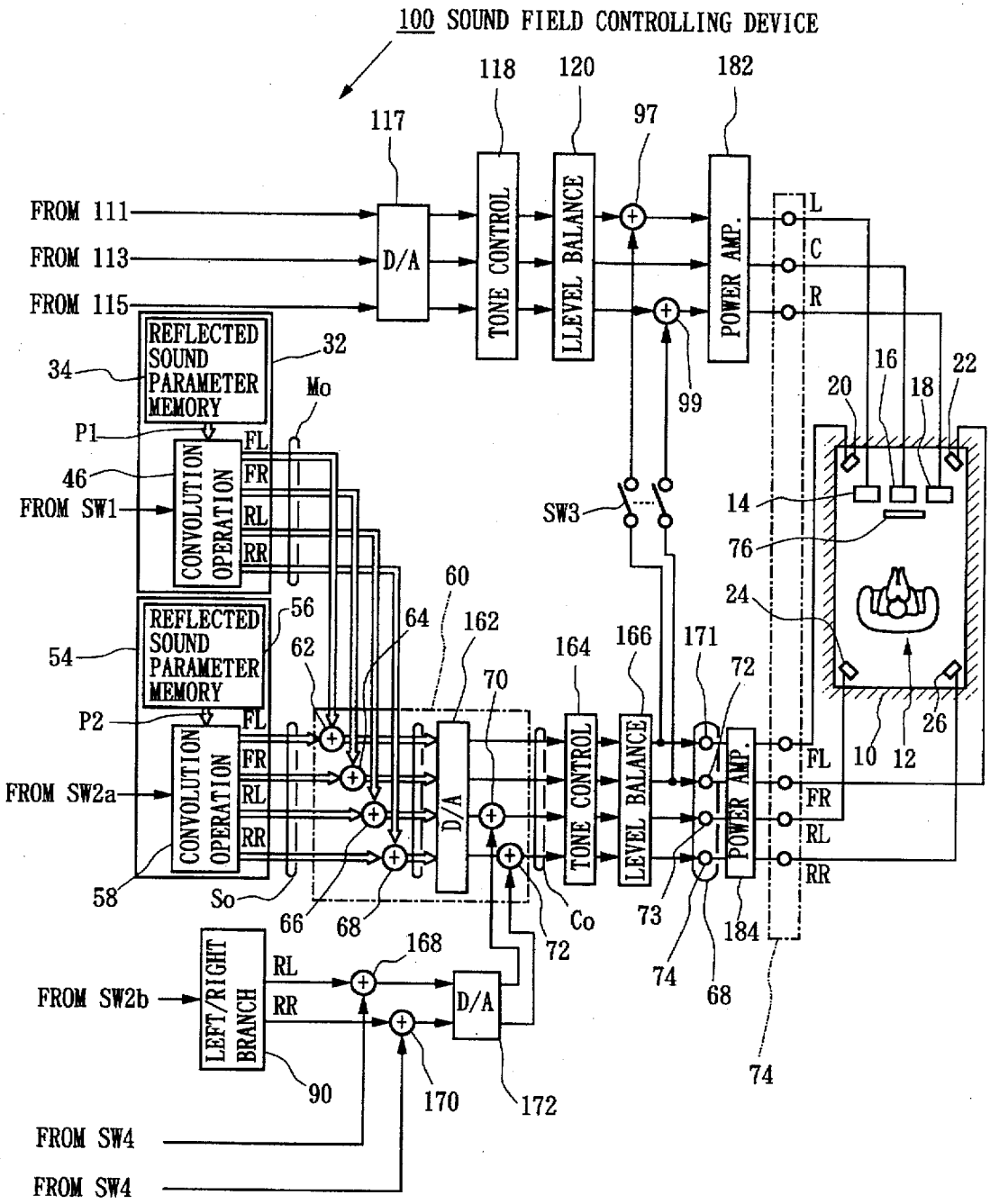

FIGS. 4A and 4B illustrate a sound field controlling device 100 according to another embodiment of the present invention, which is characterized in that it automatically switches circuitry arrangement in response to the type of input signals. In FIGS. 4A and 4B, same reference characters as in FIG. 1 denote same elements as in the figure. In the sound field controlling device 100, input section 11 includes an input terminal 102 for serial digital signals encoded on the basis of the AC-3 system, and input terminals 104 and 106 for conventional two-channel signals L and R (encoded for example on the basis of Dolby prologic surround (trademark) system). The AC-3-based signals received via the input terminal 102 are decoded by an AC-3 decoder 108 into discrete signals of five channels L, C, R, SL and SR.

There are five modes of the AC-3 signals which are classified by combinations of the channels contained, as indicated in Table 1 below, where the first numeral (numerator) of each mode name indicates the number of main channel and the second numeral (denominator) indicates the number of surround channel.

TABLE 1

| Mode Name | Channels |
|---|---|
| 3/2 Mode | L, C, R, SL, SR |
| 3/1 Mode | L, C, R, S |
| 2/2 Mode | L, R, SL, SR |
| 2/1 Mode | L, R, S |
| 2/0 Mode | L, R |

In the 3/1 and 2/1 modes above, there is only one surround channel (monaural), and a same surround signal is output from surround output channels SL and SR of the AC-3 decoder 108. In the 2/2, 2/1 and 2/0 modes, main signals are output from two channels L and R of the AC-3 decoder 108, and no signal is output from center output terminal C of the decoder 108. In the 2/0 mode, there is no surround channel, and hence no signal is output from surround output terminal C of the AC-3 decoder 108. The type of these modes is determined from channel information contained in the AC-3 signals.

The two-channel signals L and R, based on, for example, Dolby prologic surround system and received via the input terminals 104 and 106, are fed to a directional property emphasizing circuit 110, which compares the levels of the input signals $L_\tau$ and $R_\tau$, and $L_\tau+R_\tau$ and $L_\tau-R_\tau$, in order to determine superiority between the channels. Then, in accordance with the superiority determination, the emphasizing circuit 110 controls the respective levels of the two-channel signals and decodes the level-controlled signals into four-channel signals L, C, R and S via a matrix circuit (not shown).

These signals of channels L, C, R and S are added to the above-mentioned five-channel output signals of the AC-3 decoder 108. More specifically, while the output signals L, C and R of the directional property emphasizing circuit 110 are directly added to the output signals L, C and R, respectively, of the AC-3 decoder 108 by means of corresponding adders 111, 118 and 115, the other output signal S of the emphasizing circuit 110 is branched to be attenuated by 3 dB via respective attenuators 117 and 119 and then added to the output signals SL and SR, respectively, of the decoder 108 by means of corresponding adders 121, 123. The reason why the output signal S is attenuated by 3 dB is to prevent the rear sounds based on the signals SL and SR from increasing in volume by 3 dB with respect to the front sounds based on the signals L, C and R in the case where the output signals L, C, R and S of the directional property emphasizing circuit 110 creates intended sound fields essentially in an energy distribution with each of the signals kept unreduced in volume.

The main signals L, C and R output from the AC-3 decoder 108 are converted via a D/A converter 117 into analog representation as necessary, and passed to a tone control circuit 118 for necessary tone color control. Then, the signals L, C and R are fed to a level balancing circuit 120 where their levels are controlled to maintain a desired balance among the channels and amplified by a power amplifier 182. The thus-amplified signals L, C and R are then led to corresponding terminals of the output section 74.

The main signals L, C and R, and inter-surround-channel difference signal (SL–SR) formed by a subtracter 125 as necessary are synthesized by a main signal synthesizing section 30 using certain weights, and then fed via a switch SW1 to a main sound field forming section 32, which forms main sound field signals Mo that afford a relatively narrow first sound field in front of the listening position 12.

The surround signals SL and SR output from the AC-3 decoder 108, and difference signal between the main signals (L–R) calculated by a subtracter 127 as necessary are added together by a surround signal synthesizing section 48 so as to provide a synthesized surround signal S. The synthesized surround signal S is passed, through a 7 kHz low-pass filter 148, modified Dolby-B type noise reducer 150, 15–30 ms delay circuit 152 and contact "a" of a switch SW2, to a surround sound image forming section 54. The surround sound image forming section 54 forms surround sound field signals So that afford a relatively wide second sound field encircling the listening position 12.

Adders 62, 64, 66 and 68 are provided in corresponding relations to the above-mentioned channels FL, FR, RL and RR, and each of the adders 62, 64, 66, 68 adds together the main sound field signal Mo and surround sound field signal So of the corresponding channel. The thus-added signals are then converted by a D/A converter 162 into analog representation as necessary.

The synthesized surround signal S is also passed via contact "b" of a switch SW2 to a left/right branch circuit 90, where the signal S is branched to left and right channels RL and RR. The branched signals are passed, via adders 168 and 170, to a D/A converter 172 to be converted into analog representation and then added by adders 70 and 72 to the left-rear and right-rear sound field signals RL and RR, respectively. Further, the surround signals SL and SR output from the decoder 108 are sent, via a switch SW4 constituting a switching means of the invention and adders 168 and 170, to the D/A converter 172 to be converted into analog representation and then added by adders 70 and 72 to the left-rear and right-rear sound field signals RL and RR, respectively.

Composite sound field signals Co thus formed and output from a composite sound field signal forming section 60 are passed to a tone control circuit 164 for necessary tone color control. Then, the signals Co are fed to a level balancing circuit 166 where their levels are controlled to maintain a desired balance among the channels and amplified by a power amplifier 184. The thus-amplified signals are then led to corresponding terminals of the output section 74, The main signals L, C and R and composite sound field signals Co (FL, FR, RL and RR) are audibly reproduced via speakers 14, 16, 18, 20, 22, 24 and 26 of the corresponding channels, respectively. Where in accordance with the listener's selection, the main speakers 14 and 18 of channels L and R are to be used also as sound field controlling speakers of channels FL and FR (i.e., where the sound field controlling speakers 20 and 22 are not provided), the signals of channels FL and FR of the composite sound field signals Co are coupled via a switch SW3 to adders 97 and 99 to be added to the main signals L and R, respectively.

Signal type determining and switching section 186 determines whether the signals input to the input section 11 are of the AC-3 type or Dolby prologic surround type or the like, and if the input signals are of the AC-3 type, the section 186 further determines which of the modes the signals are in. The type of the input signals may be determined such as by detecting which of the directional property emphasizing circuit 110 and AC-3 decoder 108 is currently being engaged in the signal processing, and the mode of the AC-3 type signals may be determined on the basis of channel information contained in the input signals.

In accordance with the determined signal type and listener's selection (i.e., selection as to whether or not sound field control is to be performed using reflected sound parameters, in the case where the operation of switch SW3 is selectable by the listener), the signal type determining and switching section 186 changes the connecting states of the switches SW1 to SW4 as shown by way of example in Table 2 below.

TABLE 2

| Type of Input Signals | Sound Field Control | SW1 | SW2 | SW3 | SW4 |
|---|---|---|---|---|---|
| AC-3 (mode 3/2) | performed | b | a | optional | on |
| AC-3 (mode 3/1) | performed | b | a | optional | off |
| AC-3 (mode 2/2) | performed | b | a | optional | on |
| AC-3 (mode 3/0) | performed | b | c | optional | off |
| AC-3 (mode 2/1) | performed | b | a | optional | off |
| AC-3 (mode 2/0) | performed | b | c | optional | off |
| AC-3 (all modes) | not performed | a | c | off | on |
| Dolby prologic | performed | b | a | optional | off |
| Dolby prologic | not performed | a | b | off | off |
| normal two channels L & R | performed | b | c | optional | off |
| normal two channels L & R | not performed | a | c | off | off |

From the manner in which the switch SW4 is controlled, it is seen that whether the surround signals should be directly used or not is decided depending on whether the number of the surround channel is one or two, irrespective of whether the input signals are the AC-3 type. Namely, in the Dolby prologic surround system which employs a monaural, single-channel surround signal, the sound field environment can not be improved if the single-channel surround signal is reproduced directly as a same sound through the two rear speakers; rather, indirect sound components will be localized, thus causing visible unnaturalness. However, this embodiment presents no such a problem, because the monaural surround signal is not directly used but used after having been converted into main sound field and surround sound field signals. The embodiment operates in the same may even for the AC-3 type input signals where there is only one surround channel.

The determination in the signal type determining and switching section 186 as to whether the number of surround channel is one or two (i.e., whether the signals of channels SL and SR are identical or not) may be made in any suitable manner other than on the basis of the channel information, such as by detecting a difference in level between channels SL and SR (namely, if the level difference is greater than a predetermined value, the two signals will be determined as different, otherwise, the two signals will be determined as identical), or by using a conventional stereo/monaural identifying circuit employed in FM receivers.

Moreover, it should be understood that the present invention is also applicable to input signals based on the discrete 5-channel method rather than the AC-3 method.

With the present invention described thus far, optimum sound field control is achieved using the original two-channel surround signals, because of the arrangement that the two-channel original surround signals are synthesized to form reflected sound signals (surround sound field signals) for creating a relatively wide sound field encircling the listening position and the original two-channel surround signals are reproduced after having been synthesized with those of the formed surround sound field signals which are to be reproduced at left and right rears or left and right sides of the listening position.

What is claimed is:

1. A sound field controlling device comprising:

input means for inputting, to said device, original main signals of three channels that are to be reproduced at left, right and center fronts of a listening position and original surround signals of two channels that are to be reproduced at left and right rear or left and right sides of the listening position;

main signal synthesizing means for synthesizing the original main signals of all the channels or of left and right channels input via said input means, so as to form a synthesized main signal;

main sound field signal forming means for, on the basis of first reflected sound parameters for creating a relatively narrow first sound field in front of the listening position, forming main sound field signals comprised of reflected sound signals of different directions defining said first sound field, with regard to the synthesized main signal;

surround signal synthesizing means for synthesizing the original surround signals of the two channels input via said input means, so as to form a synthesized surround signal;

surround sound field signal forming means for, on the basis of second reflected sound parameters for creating a relatively wide second sound field encircling the listening position, forming surround sound field signals comprised of reflected sound signals of different directions defining said second sound field, with regard to the synthesized surround signal;

composite sound field signal forming means for synthesizing the main sound field signals and surround sound field signals of corresponding channeled, and also synthesizing the original surround signals of the two channels with channels to be reproduced at left and right rear or left and right sides of the listening position, so as to form composite sound field signals of the individual channels; and output means for outputting the original main signals of the three channels along with the composite sound field signals.

2. A sound field controlling device as defined in claim 1 which further comprises:

switch means for switching between a first mode where the composite sound field signals are outputted directly from said composite sound field signal forming means, and a second mode where the composite sound field signals of only the main sound field signals and surround sound field signals are outputted from said composite sound field signal forming means without the original surround signals of the two channels being outputted therefrom.

3. A sound field controlling device as defined in claim 1 wherein said main signal synthesizing means synthesizes a difference signal between the original surround signals of the two channels in addition to said original main signals of all the channels or of left and right channels.

4. A sound field controlling device as defined in claim 1 wherein said surround signal synthesizing means also synthesizes a difference signal between the original main signals of the left and right channels in addition to said original surround signals of the two channels.

5. A sound field controlling device comprising:

decoder means for decoding input signals that are prepared by encoding, into a single-channel serial digital signal, original main signals of three channels to be reproduced at left, right and center fronts of a listening position and original surround signals of two channels to be reproduced at left and right rear or left and right sides of the listening position, and thereby outputting five-channel discrete signals comprised of said original main signals of the three channels and said original surround signals of the two channels;

main signal synthesizing means for synthesizing the original main signals of all the channels or of left and right channels input via said input means, so as to form a synthesized main signal;

main sound field signal forming means for, on the basis of first reflected sound parameters for creating a relatively narrow first sound field in front of the listening position, forming main sound field signals comprised of reflected sound signals of different directions defining said first sound field, with regard to the synthesized main signal;

surround signal synthesizing means for synthesizing the original surround signals of the two channels input via said input means, so as to form a synthesized surround signal;

surround sound field signal forming means for, on the basis of second reflected sound parameters for creating a relatively wide second sound field encircling the listening position, forming surround sound field signals comprised of reflected sound signals of different directions defining said second sound field, with regard to the synthesized surround signal;

composite sound field signal forming means for synthesizing the main sound field signals and surround sound field signals of corresponding channels, and also synthesizing the original surround signals of the two channels with channels to be reproduced at left and right rear or left and right sides of the listening position, so as to form composite sound field signals of the individual channels; and output means for outputting the original main signals of the three channels along with the composite sound field signals.

6. A sound field controlling device as defined in claim 5 wherein said main signal synthesizing means synthesizes a difference signal between the original surround signals of the two channels in addition to said original main signals of all the channels or of left and right channels.

7. A sound field controlling device as defined in claim 5 wherein said surround signal synthesizing means also synthesizes a difference signal between the original main signals of the left and right channels in addition to said original surround signals of the two channels.

* * * * *